United States Patent [19]

Howell

[11] 3,977,113

[45] Aug. 31, 1976

[54] SCOPE GUARD

[76] Inventor: Rufus J. Howell, Lot 43, S. Hillcrest, Whitehouse, Tex. 75791

[22] Filed: May 14, 1975

[21] Appl. No.: 577,607

[52] U.S. Cl. ..... 42/1 S; 33/244

[51] Int. Cl.[2] ..... F41G 1/38; F41C 27/00

[58] Field of Search ..... 42/1 ST; 33/244, 245

[56] References Cited

UNITED STATES PATENTS

| | | | |
|---|---|---|---|
| 2,599,689 | 6/1952 | Brelsford | 42/1 ST |
| 3,208,146 | 9/1965 | Nelson | 42/1 ST |

*Primary Examiner*—Charles T. Jordan

[57] ABSTRACT

A guard for the telescopic sight of a rifle prevents bumping of the sight and knocking it out of proper alignment. The guard also prevents damage to sight lenses. It allows normal usage of the sight while the protective guard is on the rifle and in one embodiment of the invention a hinged section of the guard may be elevated to expose the bolt action for usage so that spent cartridge cases may be ejected. The guard is lightweight but sturdy and its attachment clips are padded so as not to mar the rifle wood. No attachment screws or drilled holes are required.

8 Claims, 7 Drawing Figures

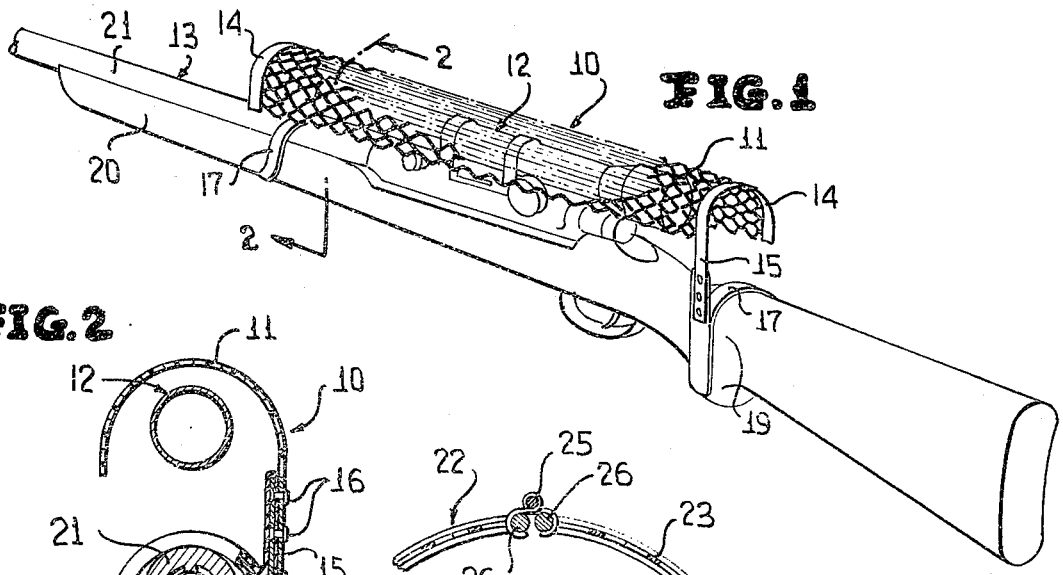
FIG. 1
FIG. 2
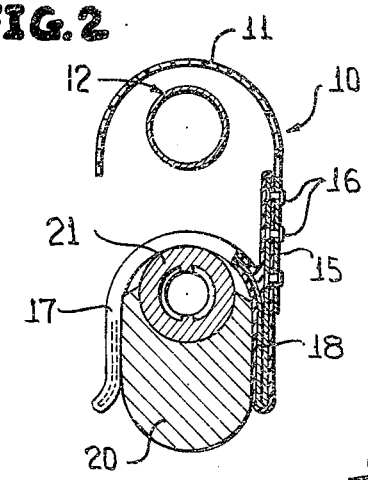
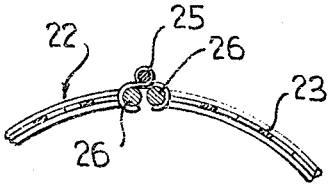
FIG. 6
FIG. 3
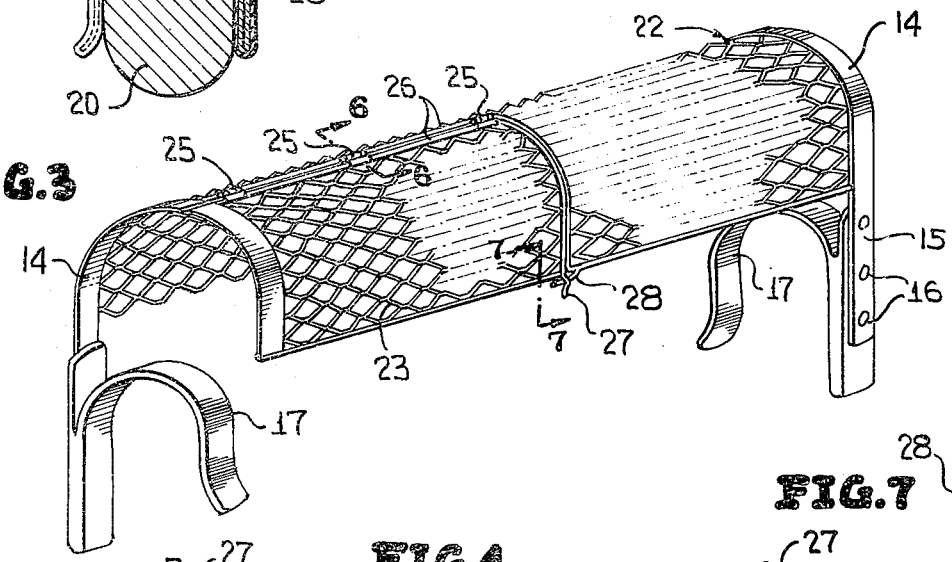
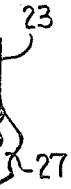
FIG. 7
FIG. 4
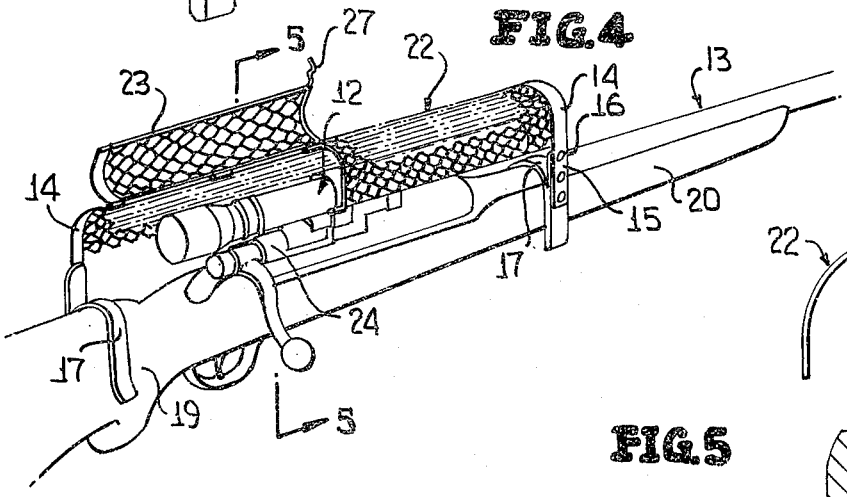
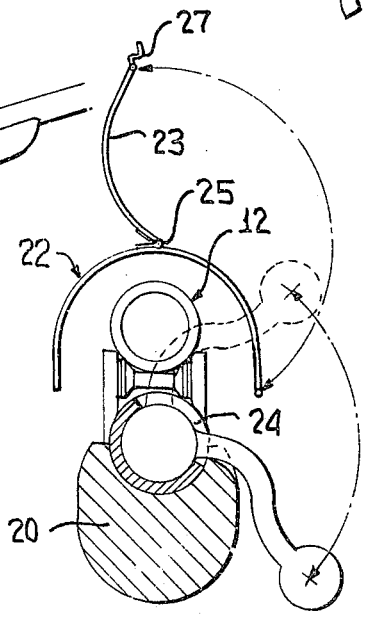
FIG. 5

SCOPE GUARD

BACKGROUND OF THE INVENTION

Guards or protectors for telescopic gun sights are known and some examples of the patented prior art are U.S. Pat. Nos. 2,599,689 and 3,208,146.

The objective of this invention is to improve on the known prior art by providing an effective scope or sight guard which is quickly and conveniently attachable to and removable from a rifle without marring or damaging the rifle and which allows normal usage of the rifle while applied thereto. The use of the guard will avoid damaging the telescopic sight and knocking the same out of alignment, as frequently occurs when no guard or protector is employed.

In accordance with a modification of the invention, a hinged section of the guard may be elevated to expose the bolt action of the rifle.

Other features and advantages of the invention will be apparent during the course of the following detailed description.

BRIEF DESCRIPTION OF DRAWING FIGURES

FIG. 1 is a perspective view of a rifle having the scope guard forming the subject matter of the invention mounted thereon.

FIG. 2 is an enlarged transverse vertical section taken on line 2—2 of FIG. 1.

FIG. 3 is a perspective view showing a modified form of guard according to the invention.

FIG. 4 is a further perspective view of the modified guard on a rifle with the hinged section of the guard elevated.

FIG. 5 is a transverse vertical section taken on line 5—5 of FIG. 4.

FIG. 6 is an enlarged fragmentary vertical section taken on line 6—6 of FIG. 3.

FIG. 7 is a similar section taken on line 7—7 of FIG. 3.

DETAILED DESCRIPTION

Referring to the drawings in detail, wherein like numerals designate like parts, and referring first to FIGS. 1 and 2, there is shown a telescopic sight guard 10 having a body portion 11 preferably formed of expanded metal and being approximately semi-circular in cross section and open at its bottom while in its normal use position. The opposite ends of the scope guard are also open and unobstructed to allow normal usage of the gun sight while the invention is mounted on a rifle. As shown in the drawings, the guard 10 is sufficiently long and wide to enclose the entire telescopic sight assembly 12 of the rifle 13 while being held in spaced relation from the sight, as clearly shown in FIG. 2.

The opposite ends of the expanded metal body 11 have relatively rigid frame elements 14 attached thereto in oppositely facing directions. Corresponding depending vertical arm extensions 15 of these end frames are riveted or otherwise firmly secured at 16 to inverted U-shaped spring clips 17 which also face in opposite directions transversely of the rifle. The spring clips and adjacent metal parts are preferably covered with resilient plastic or similar padding indicated at 18 to avoid marring or scratching the wooden portions of the rifle on which the guard is mounted. The two attaching spring clips 17 are spaced vertically below the opposite ends of the guard body as shown in FIG. 2.

The rearward clip 17 snugly and frictionally engages over the rifle stock 19 while the forward clip 17 engages over the rifle forearm 20 and adjacent portion of the gun barrel 21. While the guard is readily removable from the rifle at any time, the two spring clips 17 firmly mount the guard in covering protective relationship to the telescopic sight 12. As shown in FIG. 2, the opposite side walls of the guard preferably extend somewhat below the bottom of the sight to fully protect the same, and the opposite ends of the guard extend well beyond the ends of the sight. The guard, while sturdy, does not add greatly to the weight of the rifle. It is fully capable of protecting the sight from direct contact with objects likely to damage it or to knock it out of alignment. While expanded metal is a preferred material for use in making the guard 10, other suitable materials could be employed, such as certain tough, fracture-resistant plastics.

In FIGS. 3 to 7 of the drawings, there is shown a modification of the invention which differs from the previously-described embodiment only in one respect. In the modification, the expanded metal guard body portion 22 is provided on one side and at one rear quarter with an elevatable hinged guard section 23 whose purpose is to expose the rifle bolt action 24 so that spent cartridge cases may be ejected while the guard is in place.

More particularly, the hinged guard section 23 is connected with the guard body 22 by longitudinal axis hinges 25 at the top of the guard or by a continuous hinge, if preferred. As shown in the drawings, the interfitting hinge knuckles may be connected with parallel rods 26 at the tops or meeting edges of the movable and stationary guard sections, FIG. 6. The hinged guard section 23 is fastened releasably in the down or active position, FIG. 3, by any convenient form of spring latch such as the one shown in the drawings, where a curved resilient latch extension 27 carried by the hinged guard section 23 interlocks with a rod extension 28 of the fixed guard section, at the bottoms thereof near the longitudinal center of the structure. The hinges 25 may be of a type which will yieldingly hold the hinged guard section in the elevated position, as where the lock type hinges pass a dead center position and lock releasably in the open position. Regular non-locking hinges may also be utilized.

Except for the feature of the hinged guard section 23 allowing ready access to the gun bolt action, the sight guard in FIGS. 3 to 7 is identical in construction and use to the one shown and described in the prior embodiment.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A guard for a rifle-mounted telescopic sight comprising an inverted channel-like guard body having open ends and an open bottom and adapted to be placed over a sight to prevent striking of the sight by another object, and a friction clip carried by each end of the guard adapted to snugly and frictionally engage a rifle having a telescopic sight to support the guard in spaced enclosing relationship to the sight.

2. A guard as defined by claim 1 in which said body is approximately semi-cylindrical and of a length to extend beyond the ends of a telescopic sight, and said friction clips comprising downwardly open generally inverted U-shaped spring clips adapted to grippingly engage over the stock and forearm portions of a rifle.

3. A guard as defined by claim 2, and a pair of end frame members on said guard body including depending arm extensions attached to corresponding sides of said clips, whereby said guard is spaced above the telescopic sight in parallel relation therewith.

4. A guard as defined by claim 3, and said arm extensions arranged on opposite sides of the guard body at the ends thereof, and said clips attached to the arm extensions facing in opposite directions across the guard body and below said frame members.

5. A guard as defined by claim 1, and said guard body formed of expanded metal, and end frame members on the guard body including depending arm extensions attached to the friction clips.

6. A guard as defined in claim 1, and one rear side section of the guard body comprising a vertically swingable section hinged to the remainder of the guard body, and means to releasably latch the hinged guard section in a closed position coincident with the remainder of the guard body.

7. A guard as defined by claim 6, and hinge means interconnecting the guard body and said hinged section longitudinally at the top of the guard body, and said hinged section being a right rear substantial quarter section of the guard body, said hinged section adapted to remain in an elevated open position until forcefully moved to the closed position.

8. A guard as defined by claim 6, and said latch means comprising interacting spring latch parts on the guard body and said hinged section.

* * * * *